United States Patent [19]

Nomura

[11] Patent Number: 4,987,977

[45] Date of Patent: Jan. 29, 1991

[54] CONTROL APPARATUS FOR A.C. ELEVATOR

[75] Inventor: Masami Nomura, Inazawa City, Japan

[73] Assignee: Mitsubishi Denki Kabushiki Kaisha, Japan

[21] Appl. No.: 429,992

[22] Filed: Nov. 1, 1989

[30] Foreign Application Priority Data

Dec. 23, 1988 [JP] Japan ..... 63-325271

[51] Int. Cl.[5] ..... B66B 1/06

[52] U.S. Cl. ..... 187/112; 187/108

[58] Field of Search ..... 187/108, 119, 112

[56] References Cited

U.S. PATENT DOCUMENTS

| | | | |
|---|---|---|---|
| 3,917,029 | 11/1975 | Maynard | 187/108 |
| 4,337,848 | 7/1982 | Kindler | 187/115 |
| 4,545,464 | 10/1985 | Nomura | 187/119 |
| 4,554,999 | 11/1985 | Kamaike | 187/114 |
| 4,661,757 | 4/1987 | Hokari et al. | 187/119 |
| 4,667,776 | 5/1987 | Nomura | 187/105 |
| 4,667,777 | 5/1987 | Nomura | 187/112 |
| 4,713,595 | 12/1987 | Yonemoto | 318/759 |
| 4,719,995 | 1/1988 | Ikejima | 187/119 |
| 4,721,188 | 1/1988 | Araki et al. | 187/119 |
| 4,745,991 | 5/1988 | Tanahashi | 187/119 |
| 4,773,508 | 9/1988 | Mine et al. | 187/119 |
| 4,779,708 | 10/1988 | Sasao et al. | 187/119 |
| 4,815,567 | 3/1989 | Ikejima | 187/119 |
| 4,851,982 | 7/1989 | Tanahashi | 363/37 |

*Primary Examiner*—A. D. Pellinen
*Assistant Examiner*—Charles E. Echholdt
*Attorney, Agent, or Firm*—Leydig, Voit & Mayer

[57] ABSTRACT

In a control apparatus for A.C. elevator, this invention consists in comprising a current control circuit which compares a current command of a brake coil current generated by a current command generator and an actual current thereof detected by a current detector, so as to control the brake coil current, whereby a riding quality of a cage is improved. This invention further comprises a velocity control circuit which adds a bias corresponding to a load in the cage, to a reference velocity command for the cage generated by a velocity command generator, whereby the riding quality of the cage is improved still further.

2 Claims, 6 Drawing Sheets

FIG. 3(A)

BK CUR COM a

FIG. 3(B)

V DET OUTPUT b

UP DIR

DN DIR

FIG. 3(C)

BIAS c
(LOAD DET OUTPUT)

FIG. 3(D)

RUNNING
DIR COM d

H

L

FIG. 3(E)

BIAS e
(SIGN DISCR OUTPUT)

(+)

(−)

FIG. 3(F)

REF V COM f
FINAL V COM g g f g

CONTROL APPARATUS FOR A.C. ELEVATOR

BACKGROUND OF THE INVENTION

This invention relates to a control apparatus for an A.C. elevator for improving the riding quality of a cage at the start thereof.

FIG. 5 is a view showing the conventional construction of a magnet brake which is assembled unitarily with a hoist.

Normally, brake levers 50 are urged in the directions of arrows A by springs 51. In consequence, brake shoes 52 grasp a brake wheel 53 to restrain the rotation thereof. The brake wheel 53 is secured to a rotary shaft 54 which is directly coupled to a motor, and it restrains the rotation of the motor, and in turn, the movement of a cage.

Besides, cams 55 each of which is formed in the shape of the letter L turn in the directions of arrows B with the movements of the brake levers 50 in the directions A, thereby to push up a plunger 56.

When a brake coil 57 is fed with a supply voltage, the plunger 56 is attracted to descend. With the descent, the cams 55 are turned in the directions of arrows C, and the brake levers 50 are moved in the directions of arrows D against the springs 51. Accordingly, the brake shoes 52 release the braked wheel 53. Owing to the release, the rotary shaft 54 is driven by the motor so as to move the cage up or down. Here in the figure, letter X denotes the air gap of the magnetic circuit of the plunger 56. When the plunger 56 is attracted, the inductance of the magnetic circuit increases due to the disappearance of the air gap X.

A prior-art example of a control apparatus for an A.C. elevator employing the above brake, will be explained with reference to FIG. 6. In the figure, numeral 1 indicates an A.C. three phase power source, and numeral 2 an electromagnetic contactor which switches each electric path extending from the A.C. power source 1 and which has a normally-open contact 2a. A drive circuit 3 for the motor 4 is configured of, e.g., thyristors or transistors The motor 4 which is driven by the drive circuit 3, rotates the rotary shaft 54 so as to move the cage 62 up and down.

Numeral 9 designates an electromagnetic contactor which feeds the brake coil 57 with the supply voltage 10, and which has a normally-open contact 9a. A control circuit 11 is actuated by the closure of a start command contact 12, to energize the electromagnetic contactors 2 and 9 and to operate the drive circuit 3. Symbol $V_B$ denotes a control voltage source.

Shown at numeral 60 is a sheave which is coupled to the rotary shaft 54, and round which a main rope 61 is wound to move the cage 62 and a counterweight 63 up and down in a well-bucket fashion. In the above construction, a braking force is generated by deenergizing the brake coil 57, thereby to restrain the cage 62, and the brake coil 57 is energized in accordance with a start command signal, thereby to release the braking force.

In operation, when a call has occurred in the cage 62, the start command contact 12 is closed, and the control circuit 11 is actuated to energize the electromagnetic contactors 2 and 9. Thus, the contacts 2a and 9a are respectively closed to feed the drive circuit 3 with electric power by means of the A.C. power source 1 and simultaneously to energize the brake coil 57 by means of the voltage source 10. Further, an operation command is sent to the drive circuit 3 with aim taken at the timing at which current flows through the brake coil 57 to attract the plunger 56 and to release the brake wheel 53. Then, the drive circuit 3 feeds the motor 4 with electric power so as to generate a torque. The cage 62 is started to ascend or descend by the torque.

The prior-art control apparatus for the A.C. elevator is constructed and operated as stated above. Therefore, when the cage 62 is to be started, the case that the timing of releasing the brake does not coincide with the timing of the supply of the electric power to the motor 4 sometimes occurs and that the motor 4 generates the torque while a braking force is still acting on the brake. In this case, the phenomenon of the rush-up or retrogression of the cage 62 in the start mode arises depending upon the magnitude of the load in the cage and the direction of the movement of the cage, causing the riding characteristics of the cage 62 to worsen.

More specifically, as in the prior-art example show in FIG. 6, the operation of releasing the brake for the elevator is usually performed in such a way that the contact 9a is closed to apply the constant voltage E by means of the D.C. voltage source 10. Then, the coil current i increases depending upon the values of the inductance L and resistance R of the coil 57, as indicated by the following formula:

$$i=E/R[1-exp(-L/R\cdot t)]$$

On the other hand, the torque of the brake decreases with the increase of the coil current However, the increase of the brake coil current, which in turn causes the decrease of the braking torque, cannot be favorably controlled merely by applying the constant voltage E, so that the brake is instantly released in most cases. In the start mode of the elevator, accordingly, the cage 62 sometimes starts suddenly or retrogresses due to the difference in weight between the cage 62 and the counterweight 63. Even when the applied voltage E can be selected to the optimum value in the above formula, the resistance R varies due to a voltage fluctuation and a temperature fluctuation, and the increase of the current i cannot be favorably controlled.

In order to avoid such a drawback, there has been ordinarily employed a method wherein the load in the cage is detected and wherein a velocity command is biased in accordance with the detected result of the load and the running direction of the cage. With this method, however, a load detector etc. have an expensive mechanical construction, and the adjustments thereof are laborious.

SUMMARY OF THE INVENTION

This invention has been made in order to solve the problems as mentioned above, and has for its object to provide a control apparatus for an A.C. elevator which can control a brake current at high precision without being affected by a disturbance such as temperature or voltage fluctuation and which can improve the riding characteristic of a cage at the start thereof.

A control apparatus for an A.C. elevator having a brake wherein a braking force is generated by deenergizing a brake coil, so as to restrain a cage, while the braking force is released by energizing the brake coil in response to a start command signal; the control apparatus for an A.C. elevator according to this invention comprises a current control circuit which includes a current command generator for generating a command for a current of said brake coil, and which compares the current command with a current value detected by a current detector for detecting the brake coil current, so as to control the brake coil current.

Besides, the control apparatus according to this invention comprises a velocity detector which detects a rotating direction of a motor for moving the cage and a rotating speed of the motor corresponding to an actual velocity of the cage, and a velocity control circuit which includes therein a velocity command generator for generating a reference velocity command for the cage, a load detector supplied with the brake coil current command of said current command generator and the detected outputs of said velocity detector, for sensing a load in the cage and for calculating and delivering a bias value to be added to the reference velocity command, a sign discriminator for discriminating a sign of the bias value in accordance with a running direction command for the cage, an adder for adding the bias value supplied from said sign discriminator, to the reference velocity command, and a velocity controller supplied with an output of said adder and the velocity signal of said velocity detector, for comparing them and for generating a torque to be generated by the motor, whereby the reference velocity command is biased in accordance with the load in the cage.

With the control apparatus for an A.C. elevator in this invention, the compared difference between the brake current command of the current command generator and the value of the brake coil current detected by the current detector is obtained by a comparator included in the current control circuit, and the supply of the current to the brake coil is controlled so as to reduce the comparison difference, whereby the brake coil current itself is controlled at high precision without being affected by a disturbance such as temperature or voltage fluctuations.

Moreover, the brake current command of the current command generator and the output of the velocity detector are received by the load detector of the velocity control circuit so as to sense the load in the cage and to calculate and deliver the bias value which is to be added to the reference velocity command, and the sign of the bias value is discriminated by the sign discriminator in accordance with the running direction command for the cage, whereby besides the gradual decrease of the braking torque, the velocity command is biased in accordance with the load in the cage, to improve the riding quality of the cage still further.

BRIEF DESCRIPTION OF THE DRAWINGS

FIGS. 3(A) thru 3(F) are diagrams of operating waveforms at various parts in FIG. 2;

Throughout the drawings, the same symbols indicate identical or equivalent portions.

DESCRIPTION OF THE PREFERRED EMBODIMENTS

Figure 1:
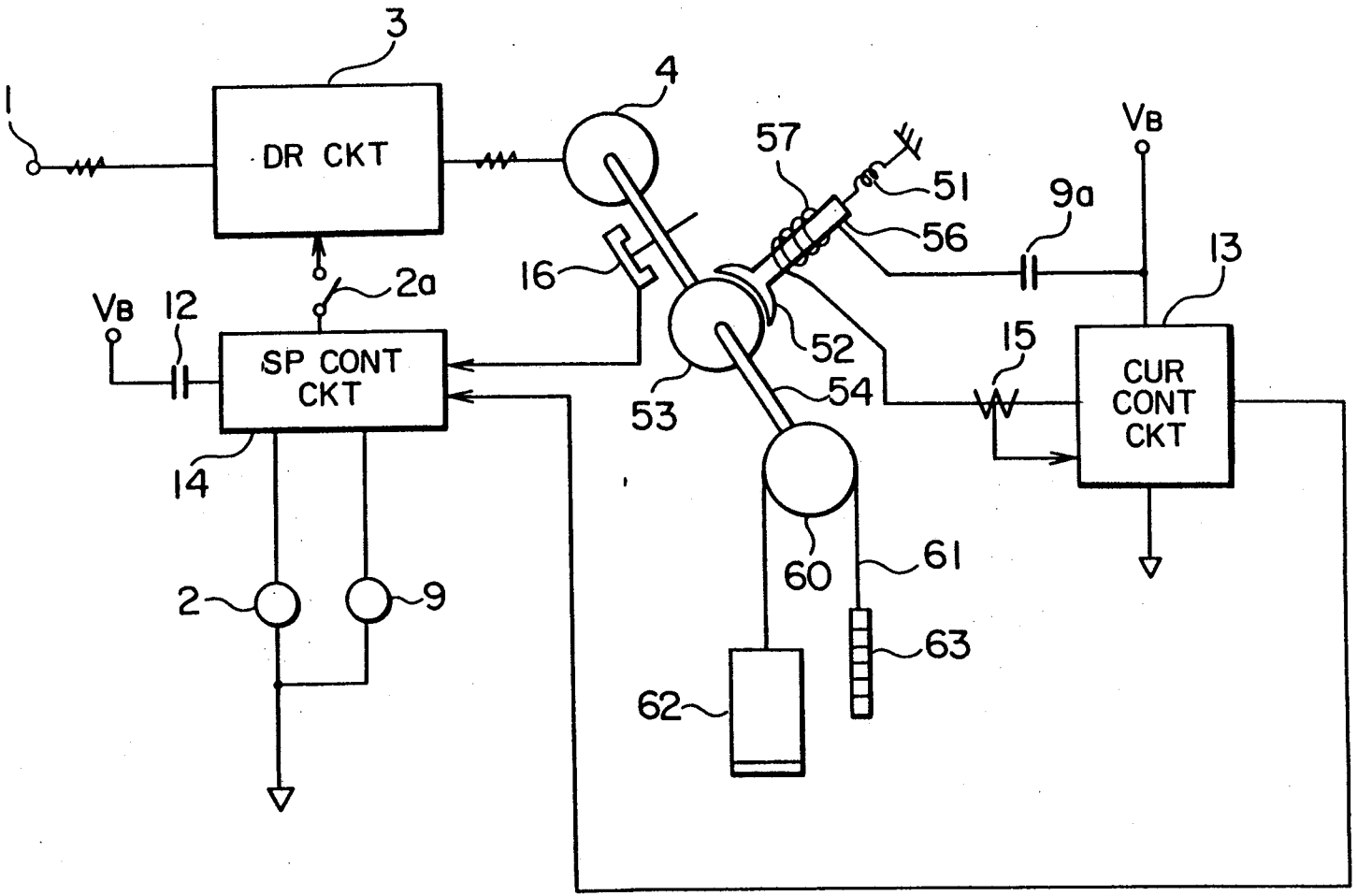
FIG. 1 is a generator arrangement view showing an embodiment of this invention.
Figure 6:
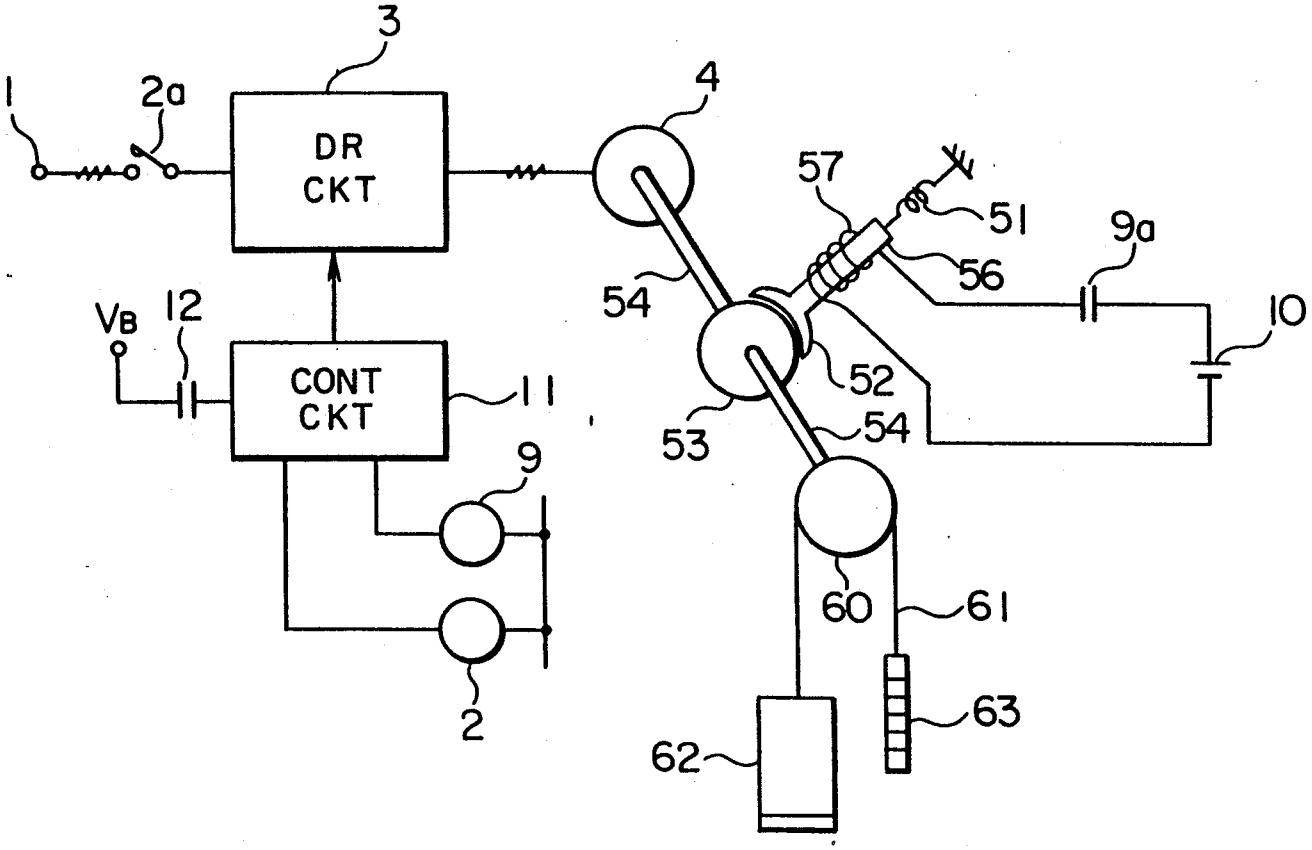
FIG. 6 PRIOR ART
FIG. 6 is an arrangement diagram of a prior-art example corresponding to FIG. 1.

Now, an embodiment of this invention will be described with reference to the drawings. FIG. 1 is a schematic view of the general arrangement of a control apparatus embodying this invention, and the same symbols are assigned to the same portions as in FIG. 6, the description of which shall be omitted herebelow. Referring to FIG. 1, numeral 13 designates a current control circuit which controls the current of a brake coil 57, numeral 14 a velocity control circuit which calculates a torque or velocity to be generated by a motor 4, numeral 15 a current detector which detects the brake coil current, and numeral 16 a velocity detector which detects the rotating speed and direction of the motor 4. The details of the interior of the current control circuit 13 as well as the velocity control circuit 14 are shown in FIG. 2.

Figure 2:
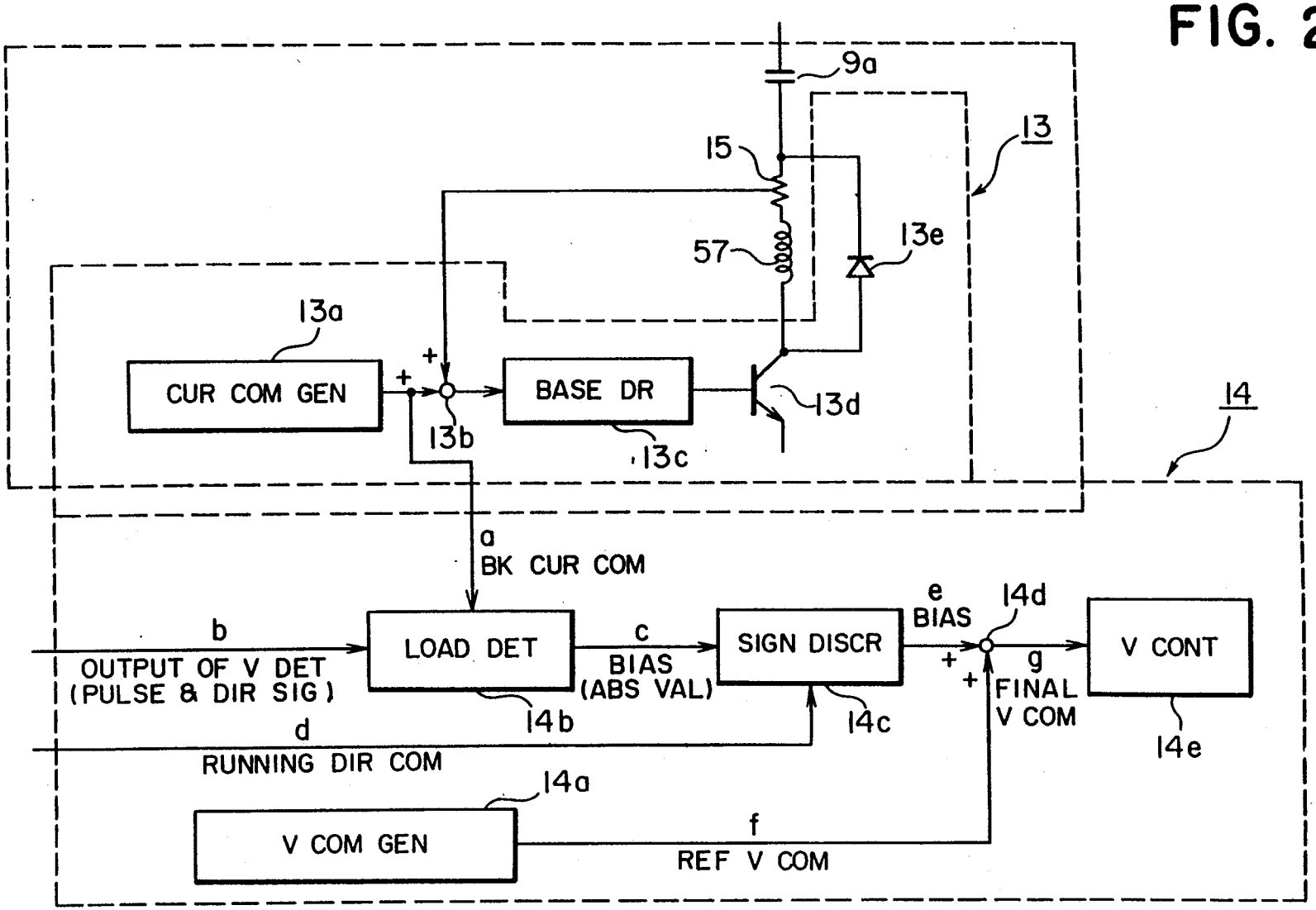
FIG. 2 is a block diagram of the internal arrangements of a current control circuit and a velocity control circuit.

Referring to FIG. 2, the current control circuit 13 is configured of a current command generator **13*a* which generates a brake current command a in response to a start command signal so as to gradually increase the brake coil current, a comparator 13*b* which compares the brake current command a with the value of the brake coil current detected by the current detector 15, a base driver 13*c* which drives and controls a transistor 13*d* on the basis of the difference of the comparison, the transistor 13*d* which is connected in series with the brake coil 57 and which controls the supply of the current, and a diode 13*e* which serves to protect the transistor 13*d***.

Owing to the provision of the current control circuit 13 thus constructed, the brake current command a from the current command generator **13*a* and the actual current from the current detector 15 are compared, and the transistor 13*d*** is controlled according to the result of the comparison so as to reduce the difference of the comparison, whereby the coil current itself can be controlled, and this current is controlled at high precision without being affected by a disturbance such as fluctuations in the temperature or voltage.

More specifically, according to the current control device 13 constructed as shown in FIG. 2, in order to improve the riding characteristics of a cage 62 at the start thereof as the object of this invention, the brake coil current itself is controlled so as to gradually reduce a braking torque, that is, it is gradually increased. Thus, the coil current, in turn, the braking torque can be precisely controlled in spite of the change of a voltage E attributed to the fluctuation thereof or that of a resistance R attributed to temperature fluctuations.

Further, the velocity control circuit 14 includes therein a velocity command generator **14*a* which generates a reference velocity command f for the cage 62, a load detector 14*b* which receives the brake current command a of the current command generator 13*a* and the output b of the velocity detector 16, for sensing a load in the cage 62 and for calculating and delivering a bias value c to be added to the reference velocity command f, a sign discriminator 14*c* which discriminates the sign of the bias value c in accordance with a running direction command d for the cage 62, an adder 14*d* which adds the output, namely, bias value e of the sign discriminator 14*c* to the reference velocity command f. and a velocity controller 14*e* which receives a final velocity command g from the adder 14*d*. Thus, besides the gradual decrease of the braking torque, the velocity command f is biased in accordance with the load in the cage 62**, whereby the riding quality can be improved still further.

More specifically, as described before, the riding characteristics of the cage 62 at the start thereof is improved by the current control circuit 13 in such a way that the brake coil current itself is controlled so as to gradually reduce the braking torque, in other words, that the coil current is gradually increased. In order to further improve the riding characteristics during the start mode of the cage 62, the load in this cage is sensed, and the bias e which corresponds to the unbalance torque between the cage 62 and a counterweight 63 is added to the velocity command f of the cage 62. Here, the load in the cage 62 may be sensed by detecting the time and the direction in which the motor 4 begins to rotate due to the unbalanced torque between the cage 62 and the counterweight 63, in the process of gradually reducing the braking torque. That is, when the braking torque has become smaller than the unbalance torque, the motor 4 begins to be rotated by the unbalance torque, and hence, the unbalance torque can be said substantially equal to the braking torque at that time. As information items for sensing the unbalance torque, accordingly, there are required a pulse which is produced from the velocity detector 16 at the beginning of the rotation of the motor 4, the direction in which the motor 4 has been rotated, and the brake coil current at that time. The unbalance torque, in turn, the cage load can be sensed with these information items (for the reason that a cage load of about 50% balances with the counterweight 63). The load detector **14*b* calculates the bias value c to be added to the velocity command f, from the brake current command a at the time at which the outputs of the velocity detector 16 have been generated. The bias value c delivered from the load detector 14*b* has its sign discriminated by the sign discriminator 14*c* in accordance with the running direction command d, and the resulting output is added to the reference velocity command f by the adder 14*d*. The output of the adder 14*d* is applied to the velocity controller 14*e*** as the actual velocity command at the start (the final velocity command g).

In the velocity controller **14*e*, the applied velocity command signal g is compared with the velocity signal of the velocity detector 16, and a torque to be generated by the motor 4 is calculated, the result being applied to a drive control circuit 3**.

FIGS. 3(A)–3(F) show diagrams of waveforms at various parts in FIG. 2. FIG. 3(A) shows the brake current command a. First, in order to quicken the load detection, current is abruptly raised to a value with which a braking torque at the degree of holding a rated load is generated. Subsequently, the current is gradually increased, thereby permitting to detect at the highest possible accuracy the point of time at which the motor 4 begins to be rotated by its load torque. In addition, FIG. 3(B) shows the velocity detector outputs b which are generated in the process of increasing the brake current command a. The point of time at which, and the direction in which the motor 4 has begun to rotate are known from the velocity detector outputs b, in the process in which the braking torque is weakened by the load. Besides, FIG. 3(C) shows that the bias output c of the load detector **14*b* whose magnitude changes depending upon the point of time when the outputs b of the velocity detector 16 are generated. Since the generation of the velocity detector output b is later, the bias output c becomes smaller. Further, FIG. 3(D) shows the running direction command d, which is set at H (a high level) for the up direction running of the cage 62 and L (a low level) for the down direction running thereof Still further, FIG. 3(E) shows the output e of the sign discriminator 14*c*. When the output direction of the velocity detector 16 agrees with the running direction of the command d, the bias output e is set at the minus value (down side), and when not, the bias output e is set at the plus value (up side). Still further, FIG. 3**(F) illustrates that the reference velocity command f to or from which the bias e has been added or subtracted is set as the final velocity command g.

Figure 4A:
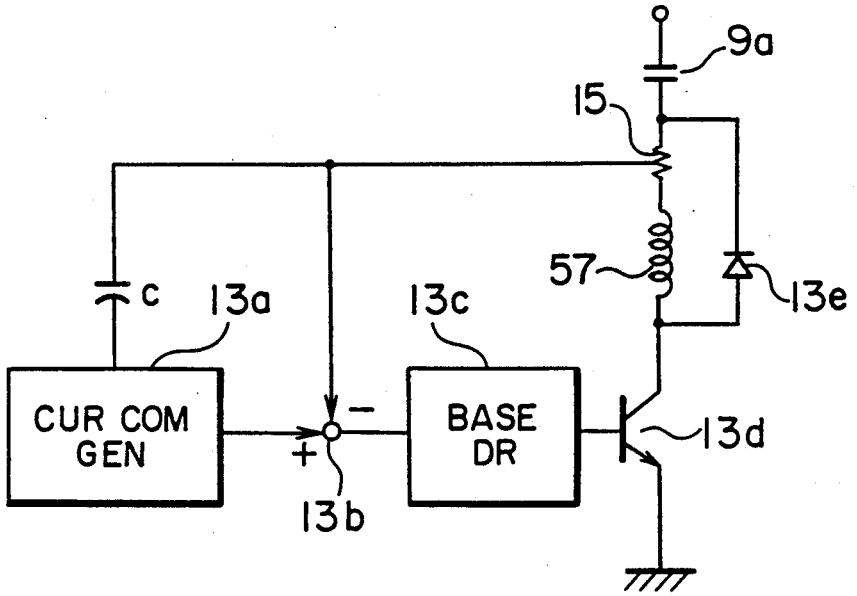
FIGS. 4(A) and 4(B) are a circuit diagram and a waveform diagram, respectively, showing a current control circuit according to another embodiment of this invention.
Figure 4B:
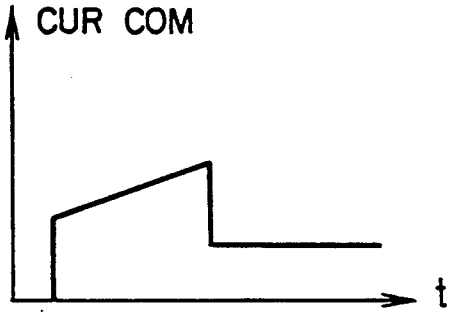
Figure 5:
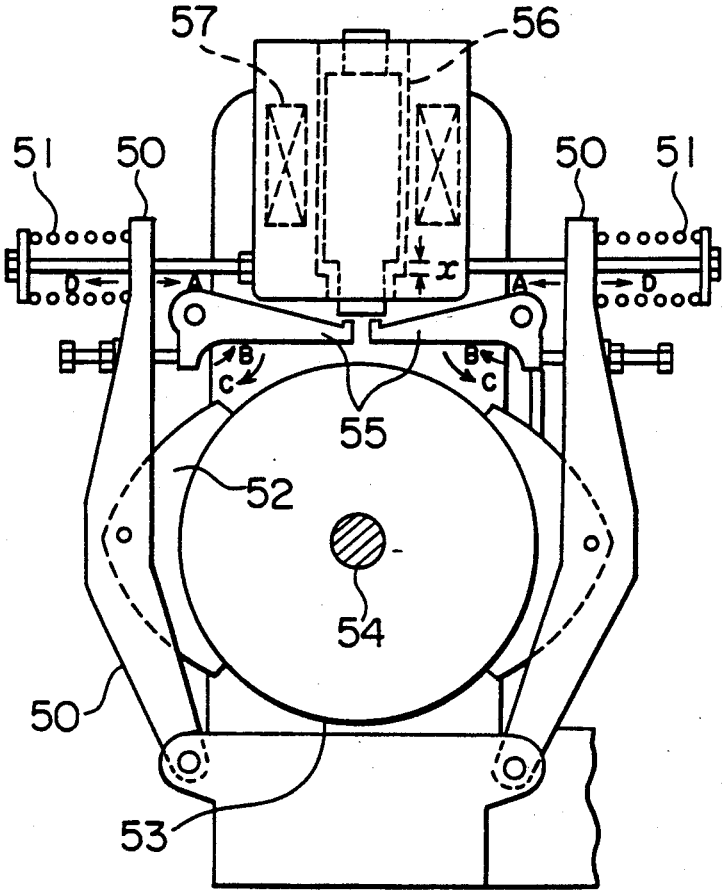
FIG. 5 PRIOR ART
FIG. 5 is a view showing the conventional construction of a magnet brake which is assembled unitarily with a hoist.

Now, FIGS. 4(A)–4(B) show another embodiment of the current control circuit 13, in which the output of the brake current detector 15 is applied to a current command generator **13*a*** through a capacitor C.

In general, a brake operates in such a manner that, when a plunger is attracted, an electromotive force based on the change of an inductance is induced to change a brake coil current instantaneously. In addition, once the plunger has been attracted, a current for holding the attracted state thereof may well be considerably smaller than a current required for the attraction. In many cases, accordingly, a switch is actuated in interlocking with the movement of the plunger, whereby the brake coil current is diminished through a resistor or the like connected to a power source. This embodiment consists in electrically detecting the attraction of the plunger and then decreasing the command value of the brake coil current.

Here, the current command generator **13*a* is configured of a CPU, a ROM table, and a D/A (digital-to-analog) converter. As illustrated in FIG. 4(B), when a start command has been received, the current command generator 13*a* raises a current command for a time up to when a current value with which a braking torque capable of holding the unbalance torque for the rated load is generated. Thereafter, the current command is gradually increased with time by retrieving digital values from the ROM table. Then, the brake coil current increases till the attraction of the plunger, and a pulse signal being the output of the brake current detector 15 is impressed on the current command generator 13*a* through the capacitor C. Since the impression, small values are retrieved as the current command. Thus, since neither the resistor for decreasing the current nor the switch interlocked with the plunger is included, the generation of heat by the brake coil 57** is suppressed, and this coil can be reduced in size. Besides, the reliability of the brake can be further enhanced.

By feedback-controlling the brake coil current in this manner, the reliability of the brake can be heightened, and the load detection is also permitted. In turn, this measure is effective to improve the riding characteristics of the cage.

As described above, according to this invention, when a cage is to be started, a brake current itself is controlled so as to gradually decrease a braking torque, that is, the coil current is gradually increased, whereby the coil current, in turn, the braking torque can be precisely controlled in spite of the change of a voltage attributed to the fluctuation thereof or that of a resistance attributed to a temperature fluctuation, and the riding characteristics of the cage can be improved.

Further, besides the gradual decrease of the braking torque, a bias which corresponds to the unbalance torque between the cage and a counterweight is added to a velocity command, whereby the riding characteristics can be improved still further.

What is claimed is:

1. A control apparatus for an A.C. elevator having a drive motor to move a cage and a brake wherein a braking force is generated by deenergizing a brake coil to restrain the cage, while the braking force is released by energizing the brake coil in response to a start command signal; said control apparatus comprising:

a current control circuit having a current command generator which generates a command for current supplied to said brake coil, which compares the current command with a current value detected a current detector which detects the brake coil current and produces a signal used by said current control circuit to operate said current command generator and to control the brake coil current, and a velocity control circuit which produces a velocity command to control torque generated by the drive motor in accordance with the load in the cage.

2. A control apparatus for an A.C. elevator as defined in claim 1, further comprising:

a velocity detector which detects a rotating direction of a motor for moving the cage and a rotating speed of the motor corresponding to an actual velocity of the cage, and wherein said velocity control circuit includes a velocity command generator which generates a reference velocity command for the cage, a load detector supplied with the brake coil current command of said current command generator and the detected outputs of said velocity detector, said load detector sensing a load in the cage and calculating and delivering a bias value added to the reference velocity command, a sign discriminator which discriminates the sign of the bias value in accordance with a running direction command for the cage, an adder which adds the bias value supplied from said sign discriminator, to the reference velocity command, and a velocity controller supplied with an output of said adder and the velocity signal of said velocity detector, for comparing them and for controlling torque generated by the motor according to the reference velocity command biased in accordance with the load in the cage.

* * * * *

UNITED STATES PATENT AND TRADEMARK OFFICE

CERTIFICATE OF CORRECTION

PATENT NO. : 4,987,977

DATED : January 29, 1991

INVENTOR(S) : Masami Nomura

It is certified that error appears in the above-identified patent and that said Letters Patent is hereby corrected as shown below:

Column 7, lines 13-14, delete "which compares the current command with a current value detected".

Signed and Sealed this

Twenty-fifth Day of August, 1992

*Attest:*

DOUGLAS B. COMER

*Attesting Officer*

*Acting Commissioner of Patents and Trademarks*